United States Patent [19]

King

[11] 4,019,700

[45] Apr. 26, 1977

[54] BEAM CREEL

[75] Inventor: Herbert R. King, Spartanburg, Scotland

[73] Assignee: Milliken Research Corporation, Spartanburg, S.C.

[22] Filed: Dec. 3, 1975

[21] Appl. No.: 637,384

[52] U.S. Cl. ..... 242/131.1; 66/213

[51] Int. Cl.[2] ..... B65H 49/02; D02H 1/00; D03J 5/08

[58] Field of Search ..... 242/131, 131.1, 75.5, 242/75.53, 45; 66/86 H, 86 J, 208–212; 28/34–36

[56] References Cited

UNITED STATES PATENTS

| | | | |
|---|---|---|---|
| 2,332,005 | 10/1943 | Nystrom et al. | 242/131 |
| 2,441,189 | 5/1948 | Eshelman | 66/86 H |

*Primary Examiner*—Leonard D. Christian
*Attorney, Agent, or Firm*—H. William Petry; Earle R. Marden

[57] ABSTRACT

A beam creel with a movable support which can be automatically moved from a loading position to a yarn pay-off position and incorporates a tension control which automatically maintains the tension in a plurality of yarn sheets from a plurality of beams mounted on the creel.

8 Claims, 9 Drawing Figures

BEAM CREEL

The object of the invention is to provide a creel for a yarn beam which can be readily loaded and unloaded and incorporates a control to maintain substantially constant tension on the yarn being supplied from the beam to a textile producing machine such as a tufting machine.

Other objects and advantages of the invention will become readily apparent as the specification proceeds to describe the invention with reference to the accompanying drawings, in which.

Heretofore tufting machines utilizing warp beams for the yarn supply have relied on the yarn feed rolls of the tufting machine to pull the yarn from the beams. The beams usually are equipped with a friction band and a weight to prevent the beam from over-running when the tufting machine is stopped. This friction, along with the mass of weight of the beam, causes considerable tension to be applied to the yarn when the tufting machine is started up and the beam is set into motion. The results often are broken ends or stop marks caused by one or more transverse rows of low loops across the width of the fabric. These rows of low loops are formed because a lesser amount of yarn was fed due to the great tension the yarn is subjected to during the start up of the tufting machine. Also the conventional beam creels in use today do not provide any means for adjustment of the friction band as the beam decreases. This also causes a continuous change in the tension of the yarn during the tufting process from the start of a full beam until the beam is empty. The results are the weight of the tufted fabric is constantly changing and usually there is considerable difference in the weight per square yard taken at the start of a full beam compared to a square yard produced near the end or empty beam. It will be understood that even though the yarns are fed by feed rolls which are driven constantly in timed relation with the tufting machine, variancies can and do occur due to the elasticity of the yarn. This means, when greater tension is applied to the yarn, lesser amounts will be fed to the needles as the feed rolls receive yarn in a stretched out or elongated condition.

To overcome the above mentioned difficulties, the herein disclosed beam creel has been developed to supply yarn to a tufting machine at a substantially constant tension. As will be recognized the herein disclosed beam creel can also be employed with other yarn consuming machines which require substantially constant yarn tension for efficient production of a textile product.

Figure 1:
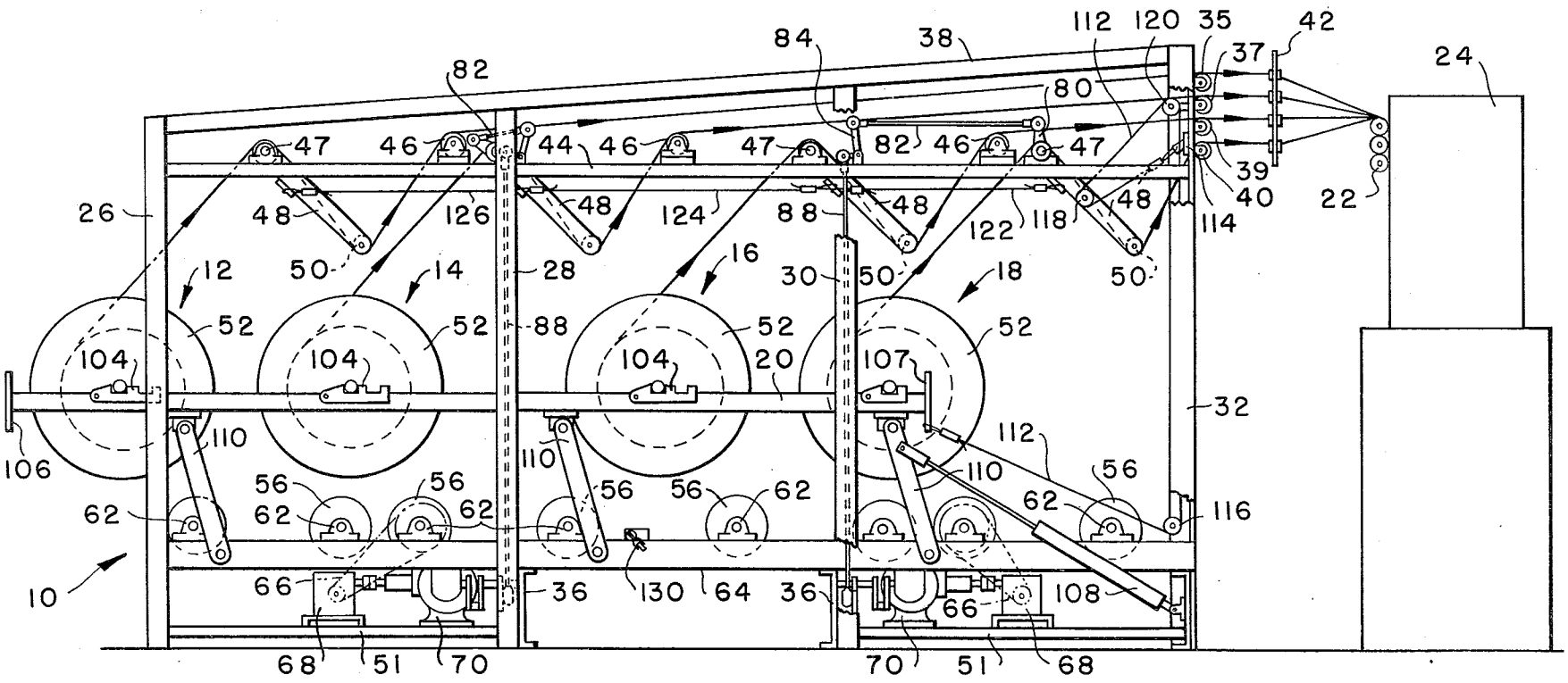
FIG. 1 is a side elevation view showing the creel in the loading and unloading position.

Looking now to FIG. 1, the new and improved beam creel 10 is loaded with a plurality of yarn beams 12, 14, 16 and 18 which are shown positioned on the loading bar 20 and threaded up to the feed rolls 22 of the tufting machine 24.

The beam creel has a support structure which includes a plurality of vertical support members 26, 28, 30 and 32 interconnected by upper cross-beams 34 and lower cross-beams 36. In the direction of the creel towards the tufting machine, each vertical member is higher than the next preceeding support member to accommodate the passage of yarn from the various beams and are connected and rigidly received by inclined beams 38. Mounted across the vertical beams 32 closest to the tufting machine 24 are a plurality of idler rolls 35, 37, 39 and 40 to guide the yarn sheets from the various beams to the feed rolls 22 through the thread board 42.

Extending longitudinally of the creel 10 on both sides thereof are angle iron beams 44 which are connected to the vertical beams 26, 28, 30 and 32. Rotably mounted, across the beams 44, on suitable bearings, are guide rolls 46 and dancer support roll shafts 47. Fixed to opposite sides of each dancer support roll shaft 47 are dancer roll support arms 48 between which at the end thereof is supported dancer roll 50. Dancer roll 50, as hereinafter explained, controls the speed and direction of rotation of the warp beams 12, 14, 16 and 18.

Figure 2:
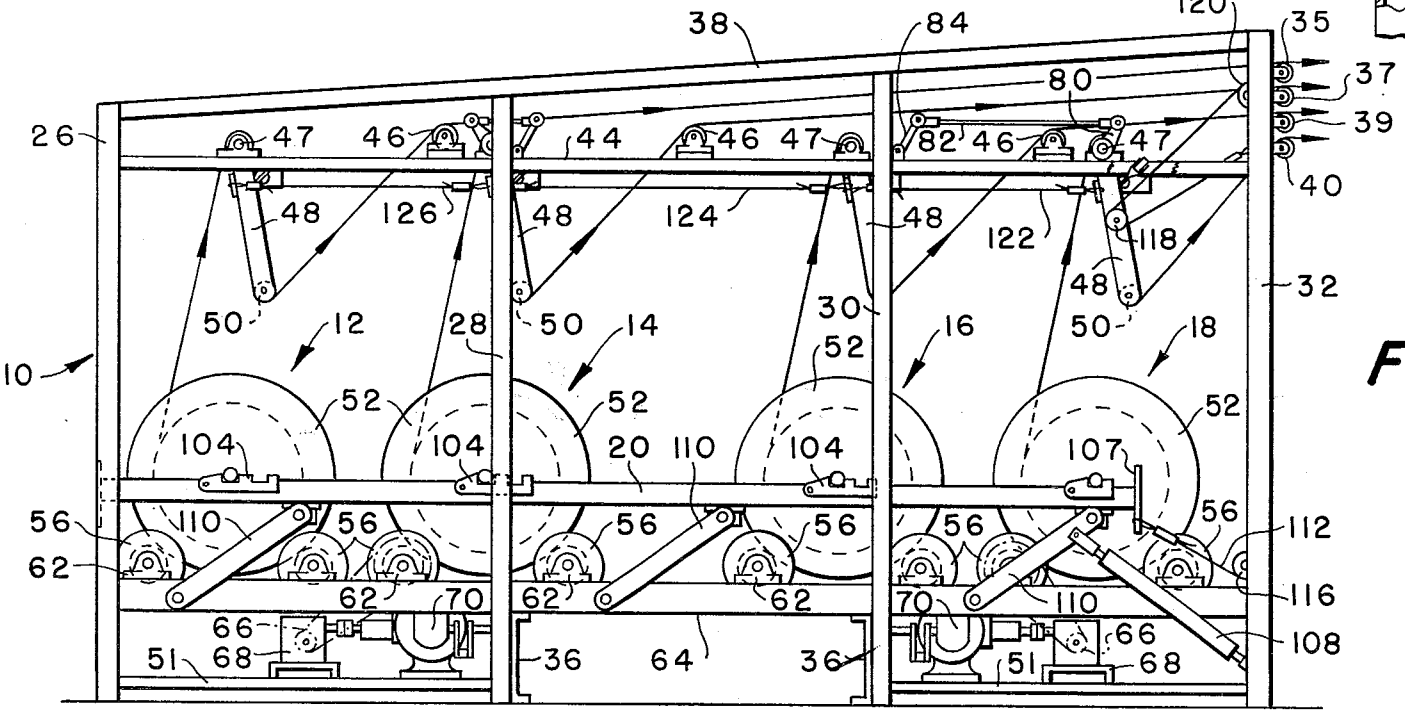
FIG. 2 is a view similar to FIG. 1 showing the creel in the operating position.
Figure 3:
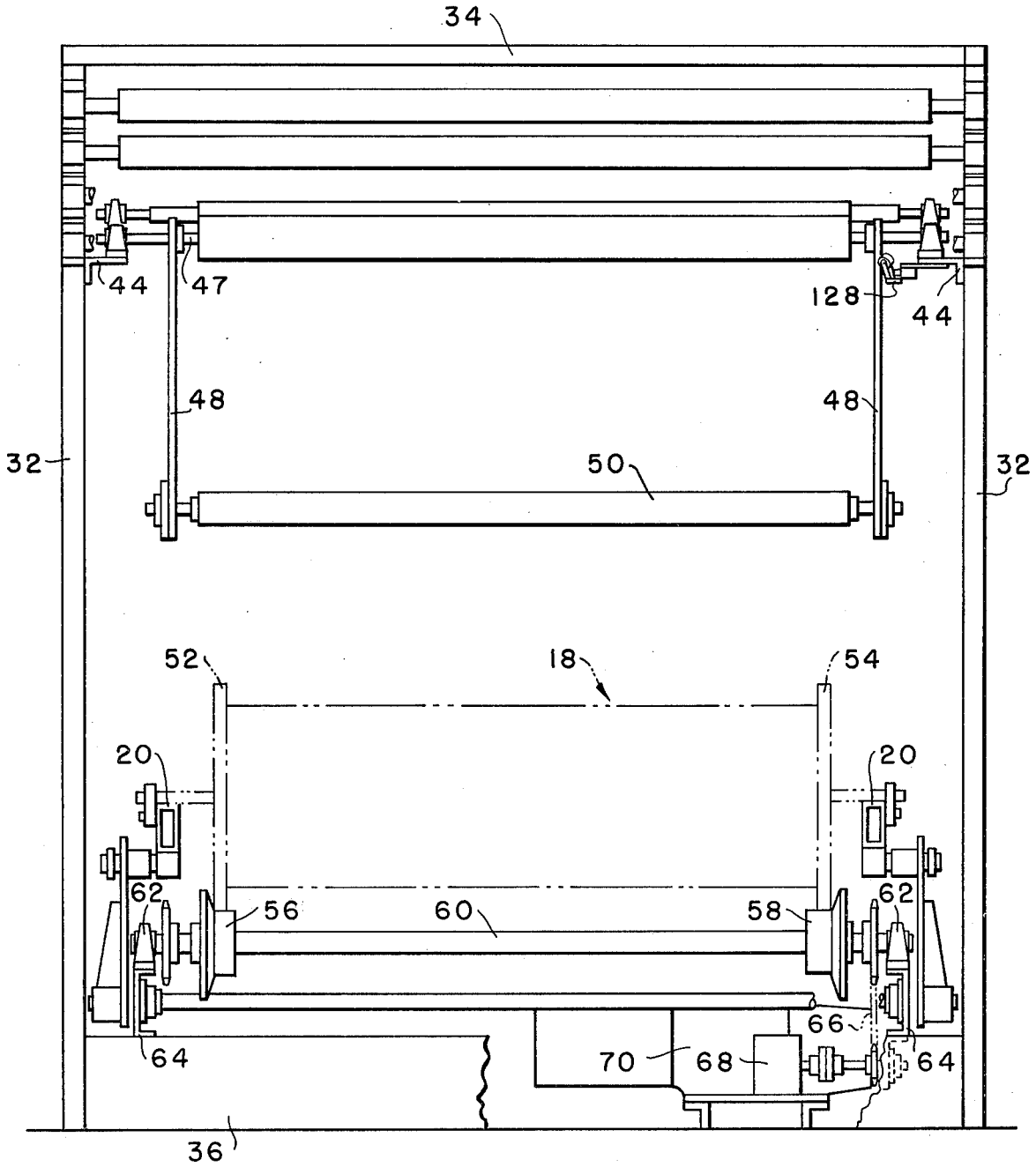
FIG. 3 is an end elevation view looking into the outlet end of the creel.
Figure 9:
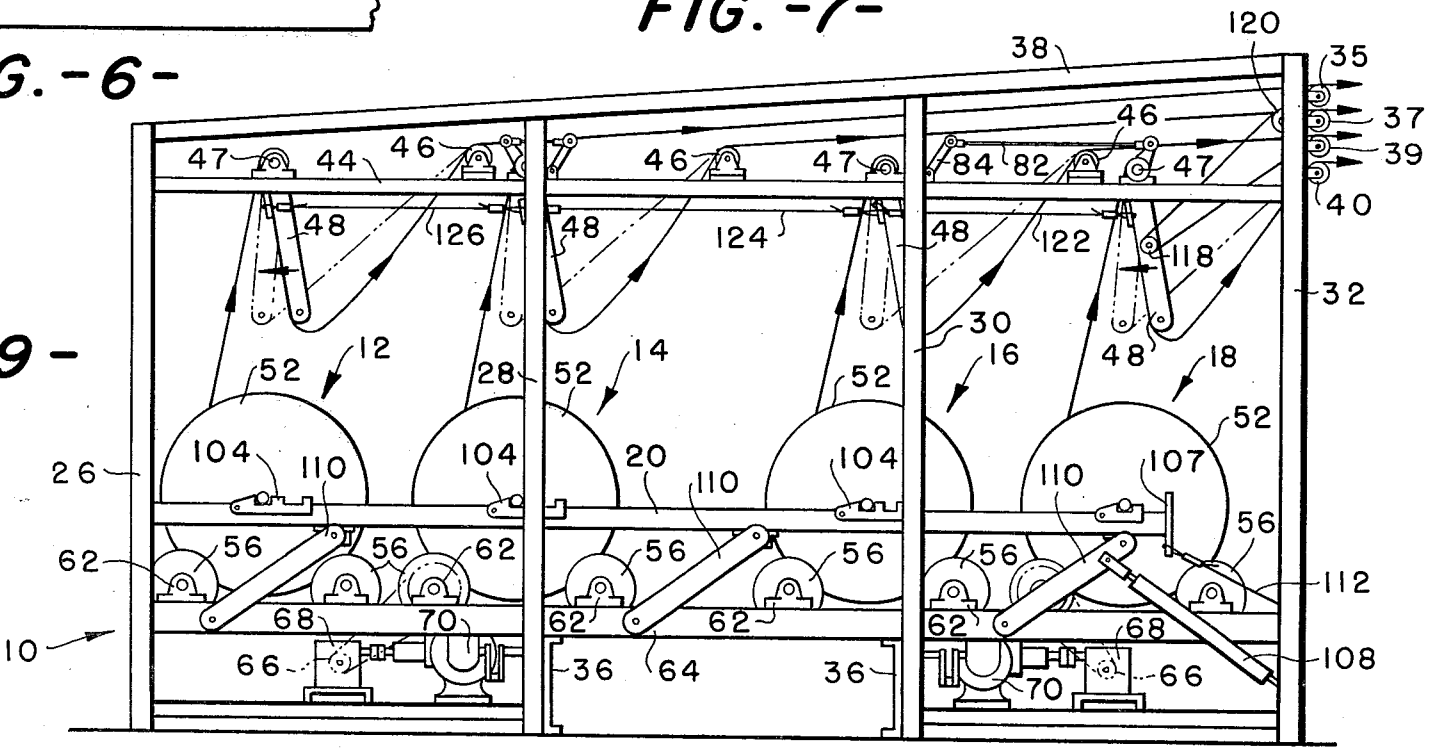
FIG. 9 is a view similar to FIG. 2 showing the yarn tension control bar in the rest position and the run position.

Mounted between the vertical supports 26 and 28 and between the vertical supports 30 and 32 are a plurality of beams 51 on which are supported the individual drives for each of the warp beams. Each of the warp beams 12, 14, 16 and 18 have flanges 52 and 54, which, as shown in FIGS. 2, 3 and 9, rest on the rubber covered collars (drive wheels) 56 and 58 fixed to the shafts 60 suitably supported in bearings 62 on I-beams 64 mounted longitudinally across lower beams 36. For each warp beam flange there are two rubber covered collars on each side of the creel with one of the shafts 60 for each warp beam being driven by a sprocket chain 66 connected to a gear box 68, which in turn is coupled to and driven by the hydraulic adjustable speed drive 70. The adjustable speed drive 70 is of a conventional type and along with the gear box 68 is mounted on the beams 51 with two drives mounted as shown in FIGS. 1, 2 and 9 and the other two drives mounted in the same position on the opposite side of the creel for the other two beams. Each of the hydraulic adjustable speed drives consist of a variable displacement pump 72, a hydraulic motor 74 and an electric motor 76. The output of the hydraulic pump to the hydraulic motor 74 is controlled by the position of the lever arms 78 which controls the displacement of the pump 72 and thus controls the output rpm of hydraulic motor 74 to the gear box 68. The position of the lever 78 for each warp beam is controlled by the position of the dancer roll 50 associated with each beam through the position of its respective dancer support roll shaft 47. The position of the dancer support roll shaft 47 positions the lever arm 80 connected thereto to position the lever arm 78 through the connecting rod 82, lever 84 connected to lever 86, push rod 88, lever 90 connected to fixed pivot part 92, lever arms 94 and connecting rod 96 pivotally connected to lever arm 78. Looking at FIGS. 1, 2 and 9 two of the push rods 88 are shown positioned behind vertical support members 28 and 30 and control, respectively, the drive for warp beams 14 and 18 while the other two push rods 88 are positioned adjacent the opposite vertical support beams to control the drive for warp beams 12 and 16. Depending on the position of the warp beam in relation to the vertical support the connecting rod 82 is long when interconnecting the dancer roll of beam 18 or short as when interconnecting the dancer roll of beam 14 which is closely adjacent the vertical support 28.

Figure 5:
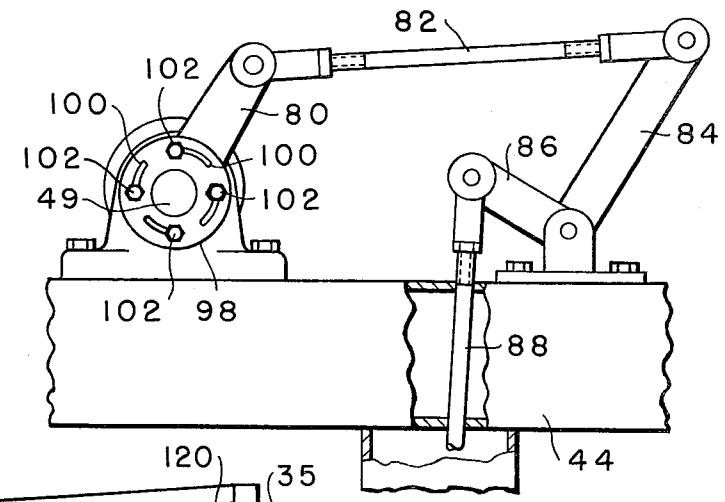
FIG. 5 is a side view of the upper portion of the drive motor speed control linkage.
Figure 4:
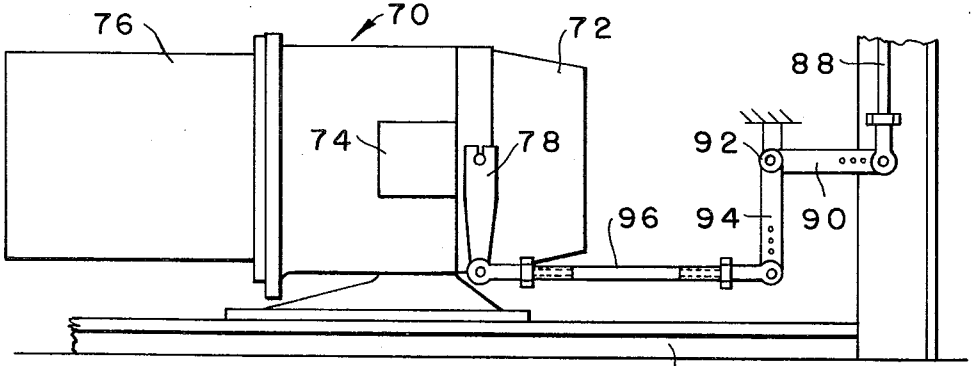
FIG. 4 is a side view of one of the creel hydraulic drive transmission and the speed control linkage.

As noted above, the lever 80 is attached to the dancer support roll shaft. Looking at FIG. 5 it can be seen that the lever 80 is integral with a collar 98 with elliptical slots 100 therein. Located on the shaft 47 is a collar (not shown) which is keyed to the shaft 47 in suitable manner and the screws 102 are screwed into tapped openings in the collar so that the position of lever arm 80 can be adjusted relative to the shaft 47 by rotating the collar in the slots 100 when the screws 102 are loosened.

Figure 8:
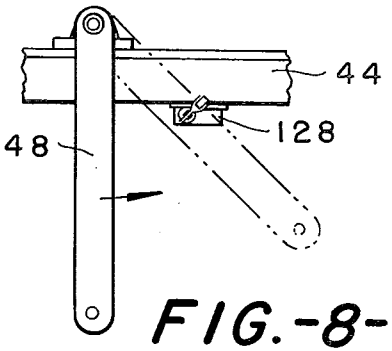
FIG. 8 is a partial side view of the yarn tension control bar.

As briefly discussed before, the warp beams 12, 14, 16 and 18 are mounted on the loading bar 20 and are locked into position by the pivoted lock member 104. Stop plates 106 and 107 are located at each end of the bar 20 to prevent the beams from rolling off the bar during loading and unloading of the beams. The loading bar 20 is movable from the loading and unloading position (FIG. 1) to the unwinding or operating position (FIGS. 2 and 9) by means of a double acting piston 108 connected to one of the lever arms 110. Lever arms 110 are pivotally connected to both the loading bar 20 and the I-beam 64 to guide the pivotal upward and downward movement of the loading bar 20. When the loading bar is pivoted upward to the position shown in FIG. 1, the dancer rolls 50 are swung upwardly by the cable 112 fixed at one end to the stop plate 107 and at the other end to plate 114 attached to the vertical support 32. The cable passes over pulleys 116, 118 and 120 to pull up the dancer roll 50 closest to the guide rolls 35, 37, 39 and 40 which in turn pulls up the other dancer roll 50 by means of cables 122, 124 and 126 to pull the dancer rolls out of the way of the warp beams. When any of the dancer rolls 50 are rotated upwardly to an extreme position, one of the support arms 48 will make the safety switch 128 knock-off the tufting machine 24 to prevent the tufting of yarn under increased tension (FIG. 8).

Figure 7:
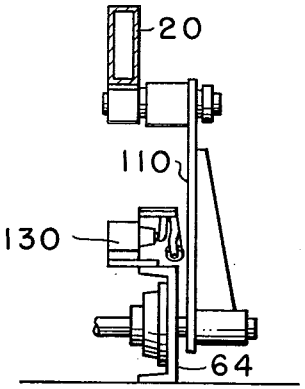
FIG. 7 is a view taken on line 7—7 of FIG. 6.
Figure 6:
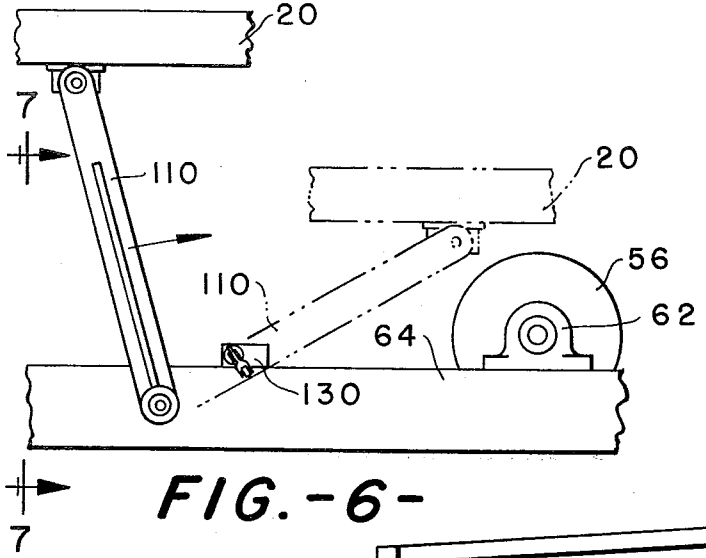
FIG. 6 is a partial view of yarn beam support bar.

Mounted on the I-beam 64 is another safety switch 130 (note FIGS. 6 and 7 in particular) which opens when disengaged by the lever 110 to cut off the warp beam drive to prevent injury to the operator when the loading bar is in the upward or inoperative position.

OPERATION

It should be understood that the electric motor 76 operates continuously and that the fluid motor 74 is capable of driving the warp beams both clockwise or counterclockwise depending on the position of the lever arm 78. Also, in the preferred form of the invention, the pre-determined operating tension is such that it is maintained without operating the warp beam drive when the axis of the dancer roll arms 48 is 5°–10° counterclockwise of the vertical axis so when the tension increases the drive will rotate the beam clockwise and will rotate the beam counterclockwise when the tension decreases. This adjustment is made by adjusting the collar 98 with attached lever 80 for each beam. Also, when the tufting machine stops the dancer roll 50 tends to assume the vertical position which will cause the warp beam drives to rotate the beams counterclockwise to maintain the desired tension for start-up of the tufting machine, once again.

Assume, for the sake of discussion, the warp beams 12, 14, 16 and 18 have run out of yarn and have to be replaced. The yarn ends to the tufting machine 24 will be cut after the tufting machine has been stopped and the piston 108 actuated to raise the loading bar 20 which opens the switch 130 to de-activate the warp beam drives 70. When the loading bar 20 is raised, the cable 112 will raise all the dancer rolls 50 to the position shown in FIG. 1. The lock members 104 will be pivoted downward and the beams rolled towards the stop 106, where they will be removed from the loading bar 20 by a crane or other suitable means. Then the full beams will be placed onto the loading bars 20, rolled into position and secured by lock members 104. Then the warp yarn from each beam will be threaded up over its respective rolls and tied to its respective end at the tufting machine. The flow of fluid, preferably oil will then be reversed to the piston 108, the loading bar 20 will return the position shown in FIG. 2 with the beam flanges 52 and 54 engaging their respective drive collars 56 and 58 and the switch 130 will be actuated to energize the warp beam drive motors. At the same time, the switch 128 will be de-energized and the tufting machine 24 can be started. When the machine 24 is started the tension of the dancer rolls will effect the position of the pump control lever 78 to control the speed and direction of rotation of the beams to maintain the desired tension on the warp yarns.

It can readily be seen that the herein disclosed warp beam creel will efficiently maintain the tension of the warp yarn and at the same time provide a creel which can readily be loaded and unloaded.

Although the preferred embodiment of the invention has been described specifically, it is contemplated that changes may be made without departing from the scope of the invention and it is desired that the invention be limited only by the scope of the claims.

That which is claimed is:

1. A creel to supply yarn to a yarn consuming machine comprising: a frame, means to rotate a plurality of yarn beams mounted in said frame, means to support a plurality of yarn beams operably associated with said frame, means to supply yarn from the yarn beams to the yarn consuming machine mounted on said frame and means to move said yarn beam support means into and out of operative relationship with said means to rotate the yarn beams, said means to support yarn beams including a pair of elongated beams pivotally mounted in said creel.

2. The creel of claim 1 wherein said elongated beams have a means attached thereto to lock each yarn beam in position thereto.

3. The creel of claim 2 wherein each of the elongated beams have a stop member mounted adjacent both ends to prevent yarn beams from rolling off.

4. The creel of claim 1 wherein said frame has a switch means to de-energize said means to rotate when said elongated beams are pivoted out of operative relationship with said means to rotate.

5. The creel of claim 1 wherein said means to supply yarn includes a pivotally mounted dancer roll means responsive to the tension of the yarn being supplied to said machine to control the speed of rotation of the yarn beams and means attached to said support means to pivot said dancer roll means upwardly out of the way when said support means are moved out of operative relationship with said means to rotate the yarn beams.

6. The creel of claim 5 wherein a means is mounted on said creel which is engaged by said dancer roll means when it is pivoted upwardly to stop said yarn consuming machine.

7. The creel of claim 1 wherein said means to supply yarn includes a means to maintain substantially constant tension on the yarn being supplied, said means to control tension including a dancer roll arrangement operably associated with the dancer roll arrangement and a linkage arrangement to vary the speed of the means to rotate the plurality of yarn beams, said linkage arrangement including a means to adjust the position of the linkage relative to the dancer roll arrangement.

8. The creel of claim 7 wherein said dancer roll arrangement includes a dancer roll support roll means and said linkage arrangement includes a lever connected to said dancer roll support roll means and rotating therewith, a slotted collar adjustably connected to said dancer roll support roll, said lever being connected to said slotted collar.

* * * * *

UNITED STATES PATENT OFFICE

CERTIFICATE OF CORRECTION

Patent No. 4,019,700 Dated April 26, 1977

Inventor(s) Herbert R. King

It is certified that error appears in the above-identified patent and that said Letters Patent are hereby corrected as shown below:

On the Title or Front Page, item [75] Inventor: "Herbert R. King, Spartanburg, Scotland" should read --Herbert R. King, Spartanburg, South Carolina--.

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*